US011028664B2

(12) United States Patent
Gallagher et al.

(10) Patent No.: US 11,028,664 B2
(45) Date of Patent: Jun. 8, 2021

(54) KINETIC SHEAR RAM FOR WELL PRESSURE CONTROL APPARATUS

(71) Applicant: Kinetic Pressure Control Limited, Houston, TX (US)

(72) Inventors: Bobby James Gallagher, Houston, TX (US); Billy Jack Gallagher, Houston, TX (US)

(73) Assignee: Kinetic Pressure Control Ltd., Houston, TX (US)

( * ) Notice: Subject to any disclaimer, the term of this patent is extended or adjusted under 35 U.S.C. 154(b) by 0 days.

(21) Appl. No.: 16/804,206

(22) Filed: Feb. 28, 2020

(65) Prior Publication Data

US 2020/0208489 A1 Jul. 2, 2020

Related U.S. Application Data

(63) Continuation of application No. PCT/US2019/025252, filed on Apr. 1, 2019.

(60) Provisional application No. 62/651,929, filed on Apr. 3, 2018.

(51) Int. Cl.
*E21B 33/06* (2006.01)

(52) U.S. Cl.
CPC ..... *E21B 33/063* (2013.01)

(58) Field of Classification Search
CPC .... E21B 33/061; E21B 33/062; E21B 33/063; E21B 33/06
USPC ..... 251/1.3
See application file for complete search history.

(56) References Cited

U.S. PATENT DOCUMENTS 3,766,979 A * 10/1973 Petrick ..... E21B 29/08 166/55
3,771,601 A * 11/1973 Garrett ..... E21B 29/02 166/297
4,305,565 A * 12/1981 Abbe ..... E21B 33/063 251/1.3
4,638,972 A * 1/1987 Jones ..... F16J 15/48 251/1.3
4,840,346 A * 6/1989 Adnyana ..... E21B 33/062 166/363
5,199,683 A * 4/1993 Le ..... E21B 33/062 137/614.17
5,501,424 A 3/1996 Williams et al.
6,131,594 A * 10/2000 Staggs ..... F16K 13/06 137/1
6,454,015 B1 9/2002 Armstrong et al.
8,794,333 B1 * 8/2014 Milanovich ..... E21B 43/0122 166/351

(Continued)

OTHER PUBLICATIONS

International Search Report and Written Opinion, International Application No. PCT/US2018/025252 dated Jul. 16, 2019.

*Primary Examiner* — Kevin F Murphy
*Assistant Examiner* — Jonathan J Waddy
(74) *Attorney, Agent, or Firm* — Victor H. Segura

(57) ABSTRACT

A blowout preventer has a main body having a through bore. A housing is mounted to the main body and defines a passage connected to and transverse to the through bore. An isolation ring cutter is initially disposed around the through bore and closes the passage to fluid flow. The isolation ring cutter is movable along the passage and has an opening coincident with the through bore. A piston and gate are disposed in the passage spaced apart from the isolation ring cutter. A propellant charge is disposed between the piston and an end.

29 Claims, 6 Drawing Sheets

(56) References Cited

U.S. PATENT DOCUMENTS

| | | | | |
|---|---|---|---|---|
| 10,465,466 | B2 * | 11/2019 | Angstmann | E21B 33/063 |
| 2010/0319906 | A1 | 12/2010 | Van Winkle | |
| 2012/0055679 | A1 * | 3/2012 | Van Winkle | E21B 33/0355 166/363 |
| 2013/0119288 | A1 | 5/2013 | Shaw | |
| 2014/0014356 | A1 | 1/2014 | Herland et al. | |
| 2014/0264099 | A1 | 9/2014 | Melancon | |
| 2016/0312904 | A1 | 10/2016 | Hoang et al. | |
| 2018/0080300 | A1 | 3/2018 | Angstmann et al. | |

* cited by examiner

KINETIC SHEAR RAM FOR WELL PRESSURE CONTROL APPARATUS

CROSS REFERENCE TO RELATED APPLICATIONS

Continuation of International Application No. PCT/US2019/025252 filed on Apr. 1, 2019. Priority is claimed from U.S. Provisional Application No. 62/651,929 filed on Apr. 3, 2018. Both the foregoing applications are incorporated herein by reference in their entirety.

STATEMENT REGARDING FEDERALLY SPONSORED RESEARCH OR DEVELOPMENT

Not Applicable

NAMES OF THE PARTIES TO A JOINT RESEARCH AGREEMENT

Not Applicable.

BACKGROUND

This disclosure relates to the field of well pressure control apparatus, namely, blowout preventers (BOPs). More specifically, the disclosure relates to actuating rams for so called "shear rams" which are used to close a BOP when there are tools, pipe or other devices in a subsurface well that prevent ordinary operation of other devices used to close a BOP.

Blowout preventers (BOPS) used with, e.g., oil and gas wells, are provided to reduce risk of potentially catastrophic events known as a blowouts, where high well pressures and resulting uncontrolled flow from a subsurface formation into the well can expel tubular products (e.g., drill pipe and well casing), tools and fluid out of a well. Blowouts present a serious safety hazard to drilling crews, drilling rigs and the environment and can be extremely costly to control, repair and remediate resulting damage. Typically BOPs have "rams" that opened and closed by actuators. The most common type of actuator is operated hydraulically to push closure elements across a through bore in a BOP housing (itself sealingly coupled to the well) to close the well. In some types of BOPs the rams have hardened steel shears to cut through a drill string or other tool or device which may be in the well at the time it is necessary to close the BOP.

A limitation of many hydraulically actuated rams is that they require a large amount of hydraulic force to move the rams against the pressure inside the wellbore and in the case of shear rams subsequently to cut through objects in the through bore.

An additional limitation of hydraulically actuated rams is that the hydraulic force is usually generated at a location away from the BOP (necessitating a hydraulic line from the pressure source to the rams), making the BOP susceptible to failure to close if the hydraulic line conveying the hydraulic force is damaged. Further limitations associated with hydraulically actuated rams may include erosion of cutting and sealing surfaces due to the relatively slow closing action of the rams in a flowing wellbore. Cutting through tool joints, drill collars, large diameter tubulars and off center pipe strings under heavy compression may also present problems for hydraulically actuated rams.

A further limitation associated with hydraulically actuated shear ram BOPs is that the cutting blades are asymmetrical which leads to a splitting force being generated during the shearing action.

Pyrotechnically actuated BOPs have been proposed which address many of the limitations of hydraulic BOPs, such BOPs including those described in International Application Publication No. WO 2016/176725 to Kinetic Pressure Control Limited. A limitation of pyrotechnic based BOPs such as disclosed in the foregoing publication is that the shearing element must cut through an isolation ring before it is possible to shear devices located in the through bore. The isolation ring is made as a heavy, thick element to exclude entry of well fluid under pressure into the pyrotechnic charge and shear storage volume at wellbore pressure. Thus, the presence of an isolation ring can significantly increase required shearing energy to ensure proper function of the shear ram(s). Further, the isolation ring may generate additional debris upon shearing which may damage sealing arrangements within the BOP.

SUMMARY

A blowout preventer according to one aspect of the present disclosure has a main body having a through bore. A housing is mounted to the main body and defines a passage connected to and transverse to the through bore. An isolation ring cutter is initially disposed around the through bore and closes the passage to fluid flow. The isolation ring cutter is movable along the passage and has an opening coincident with the through bore. A piston and gate are disposed in the passage spaced apart from the isolation ring cutter. A propellant charge is disposed between the piston and an end.

In some embodiments the blowout preventer further comprises an energy absorbing element disposed in the housing proximate the main body.

In some embodiments the blowout preventer further comprises a restraint in the housing arranged to stop motion of the piston and the gate until gas pressure from the propellant charge reaches a selected threshold.

In some embodiments, the restraint comprises a shear pin.

In some embodiments, the isolation ring cutter comprises a cutting edge formed into a circumference of the opening.

In some embodiments, the blowout preventer further comprises a seal disposed in the main body and coaxial with the through bore, the seal arranged to close the through bore to fluid flow when the gate is moved to a position laterally adjacent to the seal.

In some embodiments, the pre-initiation spacing between the gate and isolation ring cutter may be between ⅛ to ½ of the diameter of the through bore, or may be greater than ½ the diameter of the through bore.

In some embodiments, a mass of the isolation ring cutter is less than 20 percent of the combined mass of the piston and the gate.

In some embodiments, a mass of the isolation ring cutter is less than 10 percent of the combined mass of the piston and the gate.

In some embodiments, the isolation ring cutter comprises at least one of steel and ceramic.

In some embodiments, the ceramic comprises metal carbide.

A method for closing a well according to another aspect of the disclosure includes actuating a propellant charge disposed in a blowout preventer having a main body coupled to the well and including a through bore, a housing mounted to the main body, the housing defining a passage connected to and transverse to the through bore, an isolation ring cutter initially disposed around the through bore and closing the passage to fluid flow, the isolation ring cutter movable along the passage and having an opening coincident with the through bore, a piston and gate disposed in a pressure chamber spaced apart from the isolation ring cutter wherein the propellant charge is disposed between the piston and an end. Gas pressure from the actuated propellant charge moves the piston, the gate and the isolating ring cutter into the through bore cutting a device disposed in the through bore. The passage is thus sealed against fluid communication from the through bore.

Some embodiments further comprise slowing the piston by contacting an energy absorbing element disposed in the housing proximate the main body.

Some embodiments further comprise restraining motion of the piston and the gate until gas pressure from the propellant charge reaches a selected threshold.

In some embodiments, the selected threshold is set by selecting properties of a shear pin.

In some embodiments the isolation ring cutter comprises a cutting edge formed into a circumference of the opening.

In some embodiments, a mass of the isolation ring cutter is less than 20 percent of the combined mass of the piston and the gate.

In some embodiments, a mass of the isolation ring cutter is less than 10 percent of the combined mass of the piston and the gate.

In some embodiments, the isolation ring cutter comprises at least one of steel and ceramic.

In some embodiments, the ceramic comprises metal carbide.

DETAILED DESCRIPTION

Figure 1:
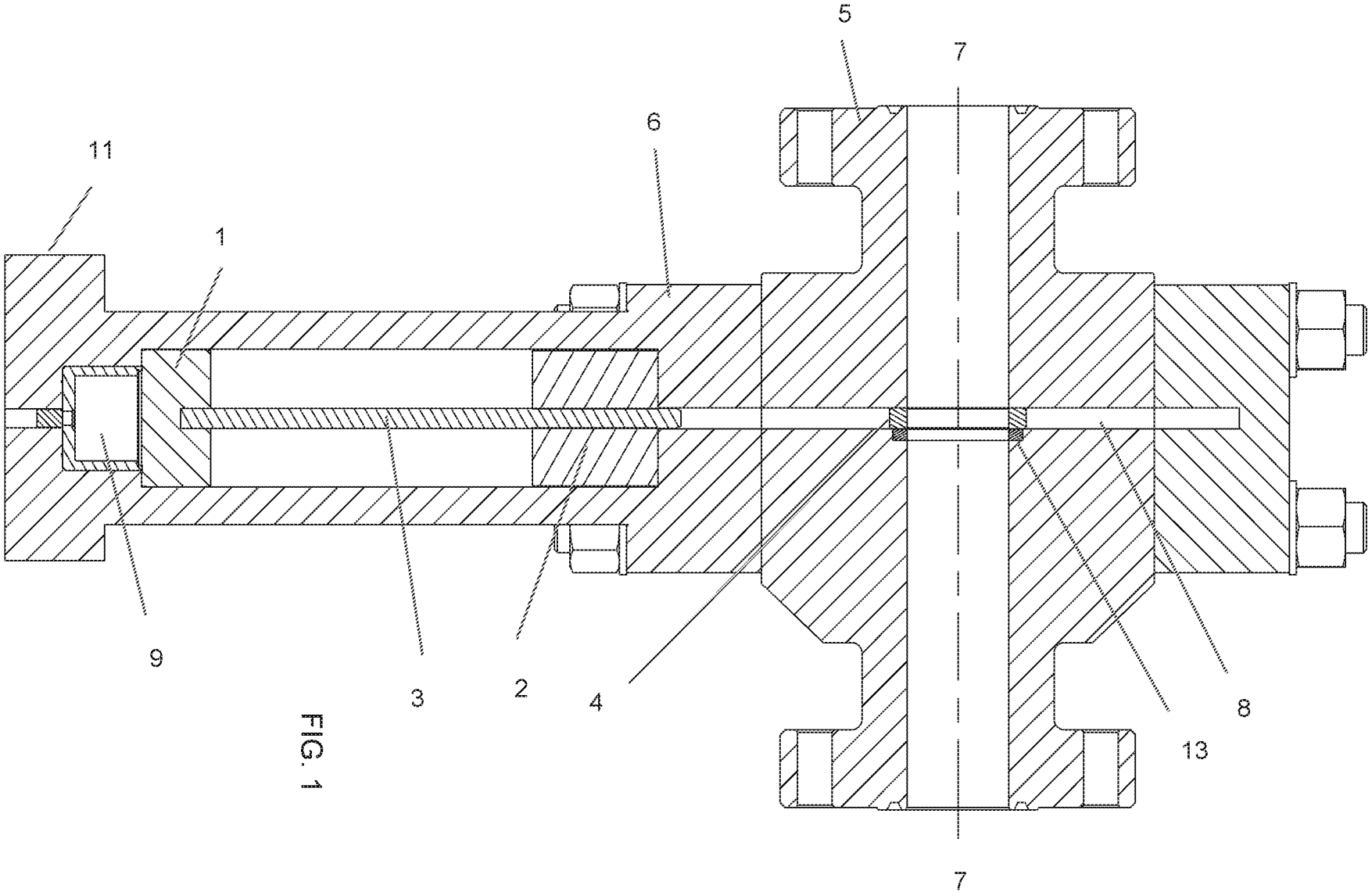
FIG. 1 shows a section view of an example embodiment of a BOP according to the present disclosure.

With reference to FIG. 1, there is shown a sectioned elevational view of an example embodiment of a blowout preventer 100 (BOP) according the present disclosure. The blowout preventer 100 has a main body 5 having a through bore 7. The blowout preventer 100 also has a passage 8 that is oriented transversely to the through bore 7. An isolation ring cutter 4 fluidly seals the passage 8, which extends from the through bore 7 into a pressure housing 10. The isolation ring cutter 4 is positioned inside the main body 5 and has an opening (see FIG. 2, element 4A) centered about the through bore 7 prior to actuation of the BOP 100. See FIG. 2 for a plan view. A cutting edge (see 4A in FIG. 2) may be formed on the circumference of the opening in the isolation ring cutter 4. A piston 1 and a gate 3 are disposed in the pressure housing 10. The gate 3 may be a flat plate, e.g., as may be made from steel, shaped to enable longitudinal motion along the passage 8 and to act in the same manner as a gate in a gate valve to close the through bore 7 as will be further explained. A charge 9, which may be in the form of a heat and/or percussively initiated chemical propellant, is located between the piston 1 and an end cap 11 at the longitudinal end of the pressure housing 10 opposite the main body 5. The charge 9 may be initiated and combust or react to produce high pressure gases, which in turn propel the piston 1 and thus the gate 3 through the pressure housing 10 and into the isolation ring cutter 4. Kinetic energy from the piston 1 and the gate 3 are transferred to the isolation ring cutter 4 to propel the isolation ring cutter 4 along the passage 8 and across the through bore 7. In addition, the gate 3 and isolation ring cutter 4 may remain in intimate contact as they travel across the through bore 7 allowing the force from the expanding gases to continue to act through the piston 1 and gate 3 and onto the isolation ring cutter 4 during shearing to increase shearing effectiveness as will be described in greater detail below.

In some embodiments, the pre-initiation spacing between the gate 3 and isolation ring cutter 4 may be between ⅛ to ½ of the diameter of the through bore 7, or may be greater than ½ the diameter of the through bore 7.

An arresting mechanism in the form of an energy absorbing element 2 is located inside the pressure housing 10 between the piston 1 and a bonnet 6. The energy absorbing element 2, which may be made from a crushable material, is adapted to absorb the kinetic energy of the piston 1 and the gate 3, as will be described in greater detail below.

The operation of the blowout preventer 100 will now be explained with reference to FIG. 2, which a cross section view of the blowout preventer 100 prior to being activated. As can be observed in FIG. 2, the charge 9, piston 1 and gate 3 are located on a first side of the through bore 7; the center line of the through bore 7 may be observed at CL.

Figure 2:
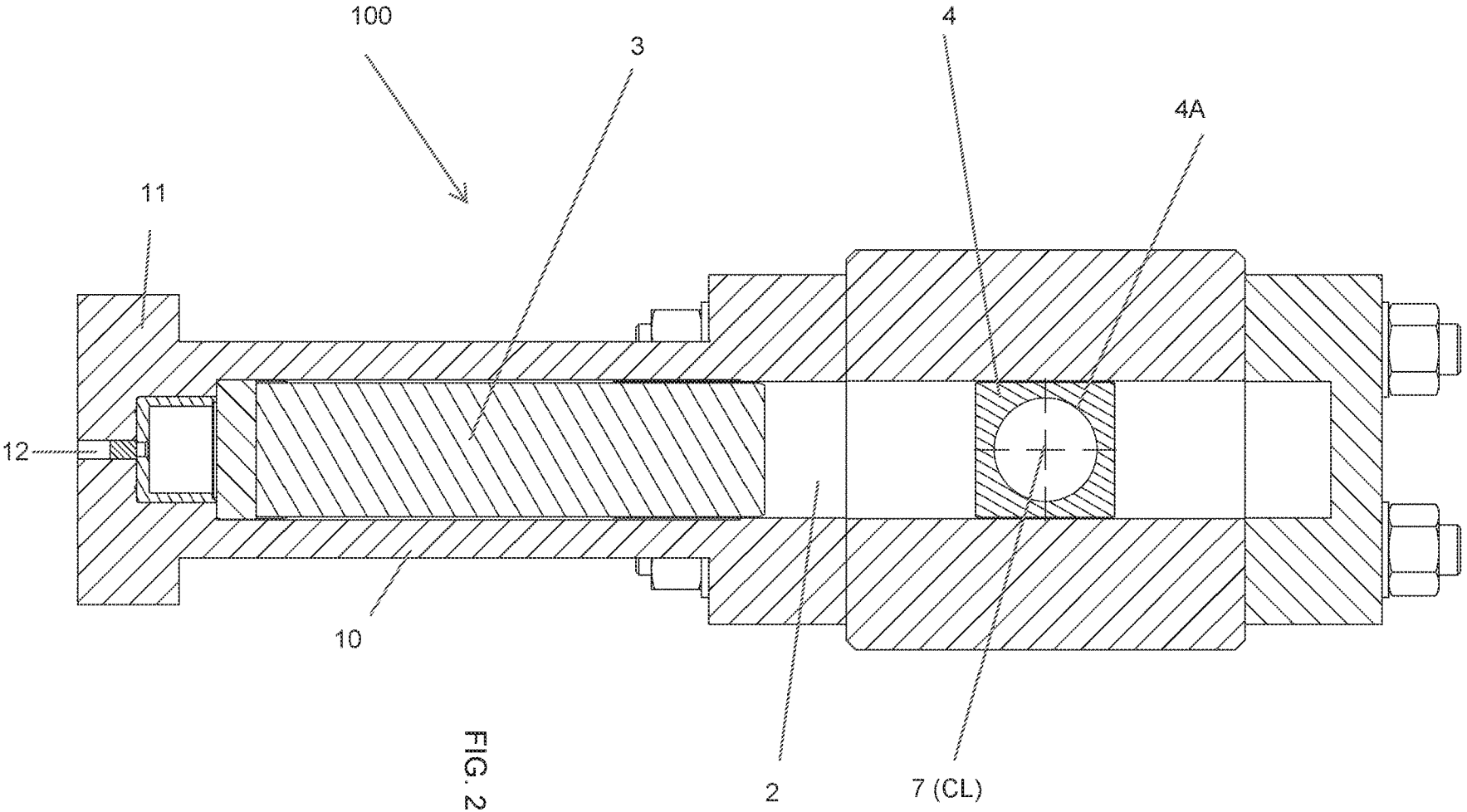
FIG. 2 shows a plan view of the BOP of FIG. 1.

FIG. 2 also shows an initiator 12 which is adapted to activate the charge 9. FIG. 2 also shows the isolation ring cutter 4 fluidly sealing the passage 8 from the through bore 7. Around the through bore 7 a through bore seal 13 may be disposed below the lower plane of the gate 3, which will be explained in more detail below.

The energy absorbing element 2 may be located within the passage 8 on the same side of the through bore 7 as the piston 1 and gate 3.

Figure 3:
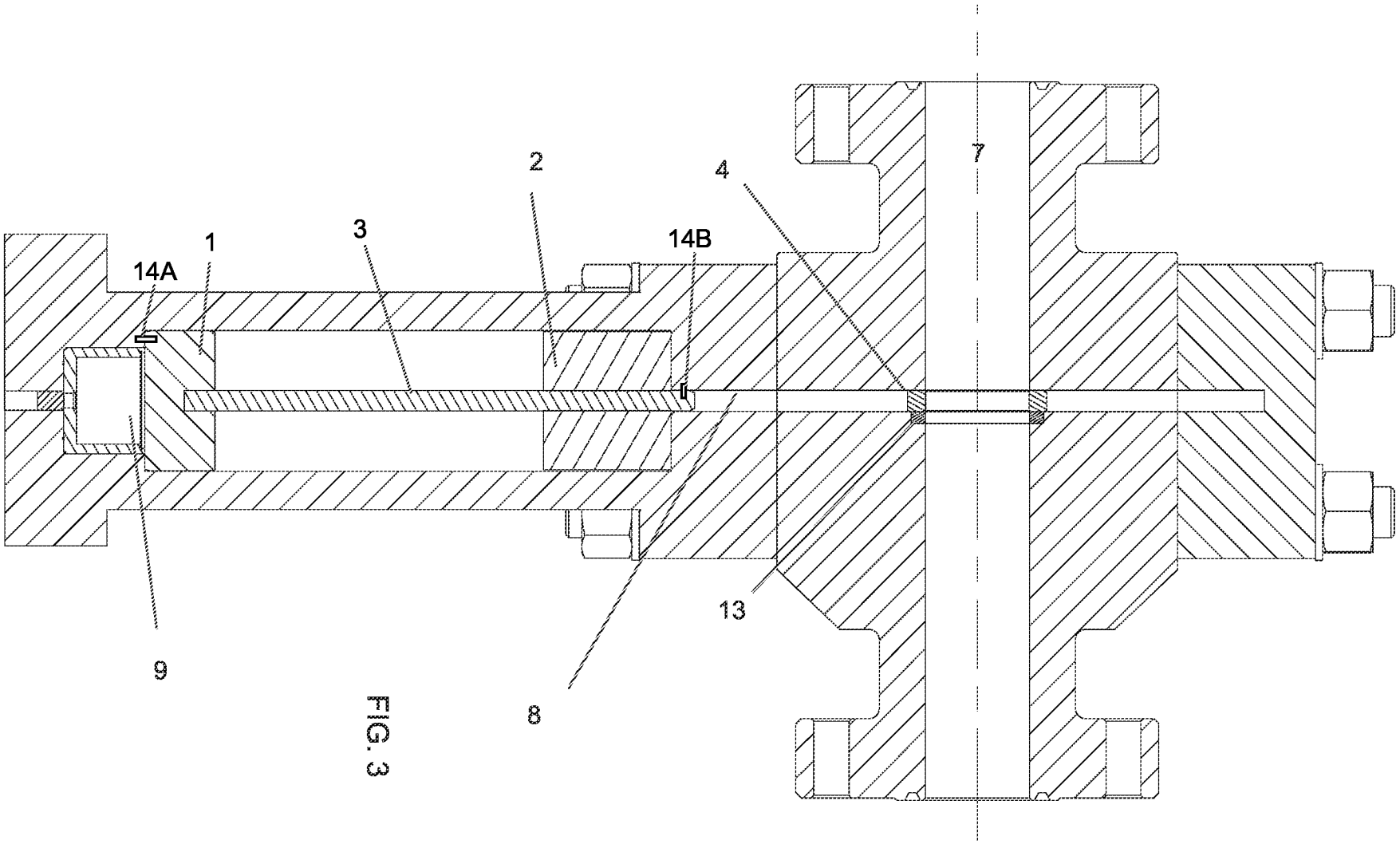
FIG. 3 shows the section view of FIG. 1 prior to initiation of a charge.

FIG. 3 shows a cross section view of the blowout preventer 100 where the charge 9 has not yet been activated by the initiator 12. The piston 1 and gate 3 are respectively held in place against the forthcoming force of gas pressure from the charge 9 acting on the piston 1 by a restraint, for example a shear pin 14A, 14B, until sufficient pressure from gases from the charge 9 has occurred after activation of the charge 9, that is, when pressure reaches a selected threshold. The restraint, if only a single shear pin or similar device, may hold either the piston 1 or the gate 3.

Figure 4:
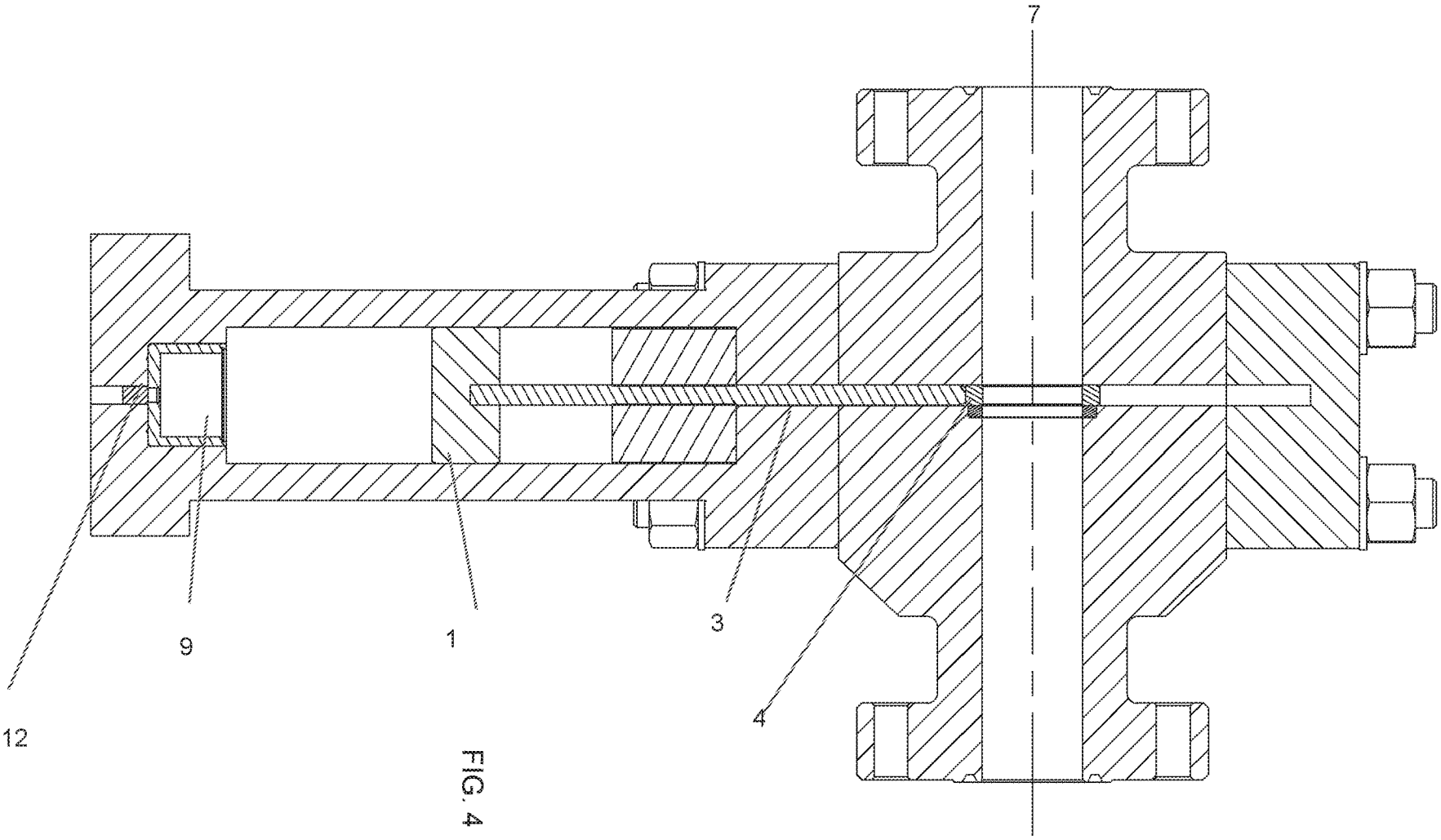
FIG. 4 shows initiation of operation of a shear element when gas pressure from the charge exceeds a selected threshold.

FIG. 4 shows a cross section view of the blowout preventer 100 where a sufficient expansion of hot gases has occurred after activation of the charge 9 to break the shear pin (not shown). At this stage, the piston 1 and gate 3 are accelerating along the passage 8 toward the isolation ring cutter 4 and the through bore 7. Once contact is made between the gate 3 and the isolation ring cutter 4, kinetic energy is transferred from the piston 1 and gate 3 to the isolation ring cutter 4, thereby propelling the isolation ring cutter 4 into the through bore 7. The gate 3 may remain in intimate contact with the isolation ring cutter 4 as it traverses the through bore 7, thereby adding to the force the isolation ring cutter 4 is able to impart during shearing. Expanding gases behind the piston 1 may continue to act on the piston 1 during shearing as the isolation ring cutter 4 traverses the through bore 7. Thus additional force is provided beyond that produced by kinetic energy from the piston 1 and gate 3. The isolation ring cutter 4 will shear any wellbore tubulars, tools or other objects which are present in the through bore 7.

Materials for the isolation ring cutter 4 may include strong and hard materials such as high strength steel and certain ceramics, such as metal carbides, e.g. tungsten carbide. Ceramics may be used for the entire structure of the isolation ring cutter 4 or may be applied as a coating to a high strength material, e.g., steel, substrate.

In some embodiments, the mating faces between the isolation ring cutter 4 and the gate 3 may be shaped to provide even loading. FIG. 4 shows that the geometry of the isolation ring cutter 4 (a flat face) and the corresponding geometry on the gate 3 (also a flat face) are complimentary, thus reducing point loading and allowing for more even stress distribution. It would also be possible to provide curved surfaces having similar radii on both the isolation ring cutter 4 and the gate 3 or a combination of flat surfaces and similar radius curved surfaces (not shown).

FIG. 4 shows that in the present embodiment the isolation ring cutter 4 is much smaller in size than the gate 4 and the piston 1. This may be advantageous in reducing shock loading when the travelling assembly (the gate 4 and the piston 1) impacts the isolation ring cutter 4. In some embodiments, the isolation ring cutter 4 has mass less than 20% of the mass of the (travelling assembly) piston 1 and gate 3 in combination. In some embodiments, the mass of the isolation ring cutter 4 it is less than 10% of the travelling assembly mass.

Figure 5:
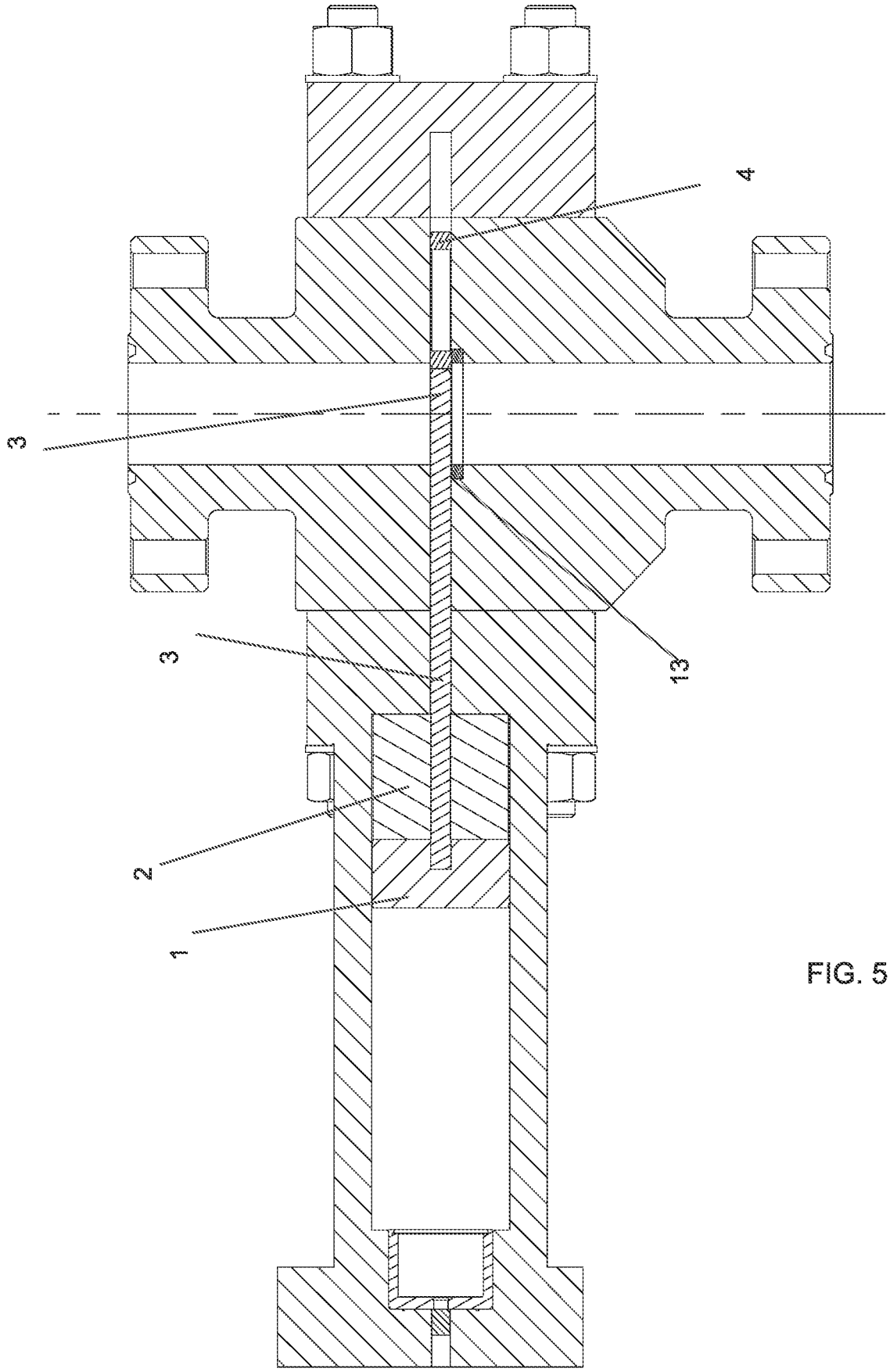
FIG. 5 shows a crush core at the beginning of crush to slow a kinetic energy gate.

FIG. 5 shows a cross section view of the blowout preventer 100. At this stage, the isolation ring cutter 4 has sheared through anything that may have been located in the through bore 7. The front face of the piston 1 has now begun to contact the energy absorbing element 2, at such point in its minimum crush state. The isolation ring cutter 4 has now begun to contact the energy absorbent material (not shown separately) of the energy absorbing element 2 located in the passage in front of the isolation ring cutter 4.

Figure 6:
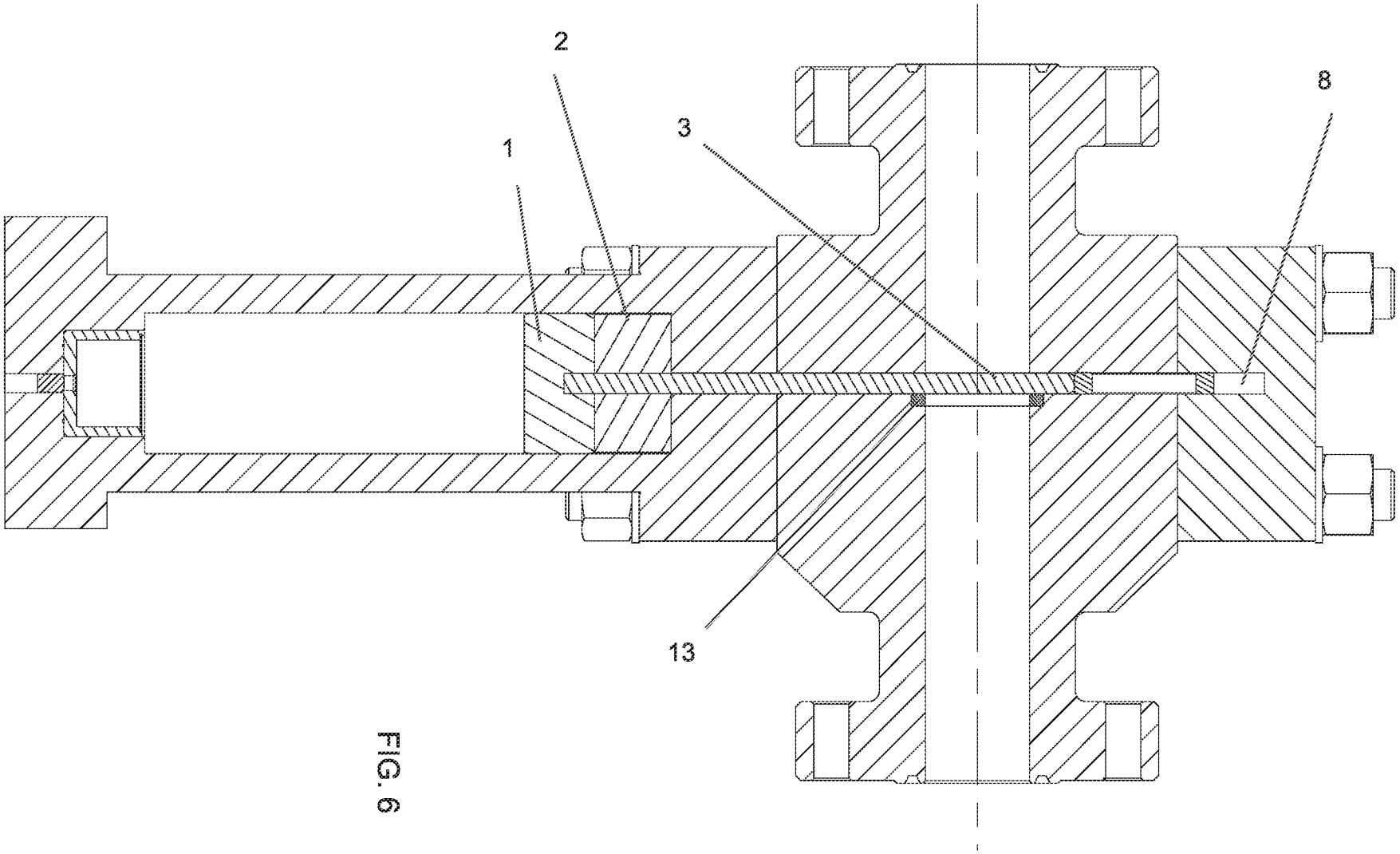
FIG. 6 shows position of the kinetic energy gate at the end of the crush.

FIG. 6 shows a cross section view of the blowout preventer 100 where the body of energy absorbing material of the energy absorbing element 2 has crumpled to a predetermined amount, absorbing the kinetic energy of the piston 1 and the gate 3. The energy absorbent material (not shown separately) located in the passage 8 has also crumpled to a predetermined amount, absorbing the kinetic energy of the isolation ring cutter 4.

The energy absorbing element 2 will retain the gate 3 in such a position that a sealing face (not shown) on the gate 3 is substantially aligned with the seal 13. When such alignment occurs, the seal 1 will laterally press against the sealing face (not shown) on the gate 3, to stop the flow of well fluids through the through bore 7, thereby securely closing the well.

Once the well is securely closed, well fluid pressure control operations (for example choke and kill operations) can commence. Once well fluid pressure control has been re-established, the blowout preventer 100 can be reopened, such as by retracting the gate 3 to open the through bore 7. For example, hydraulic fluid 15 may be introduced between the front face of the piston 1 and the bonnet 6 to cause the piston 1 to retract away from the through bore 7.

The gate 3 may optionally have a sealing face (not shown separately) which is adapted to engage with the through bore seal 13 to prevent passage of wellbore fluids from the through bore 7 into the passage 8. A sealing face (not shown) may optionally be present on at least one of a lower or upper surface portion of the gate 3. In an example embodiment, the sealing face (not shown) may be provided on at least a lower surface portion of the gate 3.

A possible advantage of a BOP made according to the present disclosure is that the blow out preventer can be actuated without having to produce hydraulic forces to hydraulically push rams across the through bore to close off the through bore. Instead, the energy required to close the wellbore is contained in the charge in the blowout preventer where it is required.

A possible advantage of holding the piston 1 and gate 3 in place by a shear pin is that this assists in the rapid acceleration of the piston 1 and gate 3 along the passage 8 once sufficient force has been generated by the expanding gases of the charge 9.

A possible advantage of having the isolation ring cutter 4 fluidly sealing the passage 8 from the through bore 7 is that the piston 1 and gate 3 can accelerate along the passage 8 unhindered by well fluids or other liquids until the piston 1 and gate 3 contact the isolation ring cutter 4.

A possible advantage of using an energy absorbing element 2 is that excess kinetic energy of the gate and piston is not directly transferred into a structural portion of the blowout preventer 100.

A possible advantage of using an isolation ring cutter 4 in connection with the piston 1 and the gate 3 is that a separate isolation ring does not need to be sheared in addition to items that may be located in the through bore. An additional possible benefit is that there is no debris from shearing a separate isolation ring that may negatively impact seal performance.

Although only a few examples have been described in detail above, those skilled in the art will readily appreciate that many modifications are possible in the examples. Accordingly, all such modifications are intended to be included within the scope of this disclosure as defined in the following claims.

What is claimed is:

1. A blowout preventer comprising:

a main body having a through bore;

a passage transverse to the through bore;

a ring cutter disposed in the passage and configured for positioning with an opening on the cutter coincident with the through bore;

a gate disposed separated and spaced apart from the ring cutter and configured for motion along the passage; and a charge configured for activation to propel the gate along the passage into contact with the ring cutter to move the cutter across the through bore.

2. The blowout preventer of claim 1 further comprising an energy absorbing element configured to absorb kinetic energy associated with motion of the gate.

3. The blowout preventer of claim 2 wherein the energy absorbing element is configured to allow the gate to progressively come to rest after the gate is propelled into motion.

4. The blowout preventer of claim 2 wherein the energy absorbing element is configured to crumple as it absorbs energy.

5. The blowout preventer of claim 1 further comprising a restraint to restrain motion of the gate until gas pressure from the charge reaches a selected threshold.

6. The blowout preventer of claim 1 wherein the ring cutter comprises a cutting edge formed on a surface of the opening thereon.

7. The blowout preventer of claim 1 further comprising a seal arrangement to restrict fluid flow between the through bore and the passage.

8. The blowout preventer of claim 1 wherein a pre-initiation spacing between the gate and the ring cutter is at least equal to ½ the diameter of the through bore.

9. The blowout preventer of claim 1 further comprising a piston disposed between the charge and the gate, and a restraint to restrain motion of the piston until gas pressure from the charge reaches a selected threshold.

10. A blowout preventer comprising:

a main body having a through bore;

a passage transverse to the through bore;

a ring cutter disposed in the passage and configured for positioning with an opening on the cutter coincident with the through bore; and a gate configured for motion along the passage in response to activation of a charge, wherein the gate is configured to move along the passage between a position separated and spaced apart from the ring cutter to a position where the gate contacts the ring cutter to move the cutter across the through bore.

11. The blowout preventer of claim 10 further comprising an energy absorbing element configured to absorb kinetic energy associated with motion of the gate.

12. The blowout preventer of claim 11 wherein the energy absorbing element is configured to allow the gate to progressively come to rest after the gate is propelled into motion.

13. The blowout preventer of claim 11 wherein the energy absorbing element is configured to crumple as it absorbs energy.

14. The blowout preventer of claim 10 further comprising a restraint to restrain motion of the gate until gas pressure from the activation of the charge reaches a selected threshold.

15. The blowout preventer of claim 10 wherein the ring cutter comprises a cutting edge formed on a surface of the opening thereon.

16. The blowout preventer of claim 10 further comprising a seal arrangement to restrict fluid flow between the through bore and the passage.

17. The blowout preventer of claim 10 wherein a pre-initiation spacing between the gate and the ring cutter is at least equal to ½ the diameter of the through bore.

18. The blowout preventer of claim 10 further comprising a piston disposed between the charge and the gate, and a restraint to restrain motion of the piston until gas pressure from the charge reaches a selected threshold.

19. A method of operating a blowout preventer having a body with a through bore, comprising:

actuating a charge to propel a gate along a passage in the body transverse to the through bore, wherein the gate is propelled from a position separated and spaced apart from a ring cutter disposed in the passage with an opening on the cutter coincident with the through bore, to a position where the gate contacts the ring cutter; and allowing the propelled gate to move the ring cutter across the through bore.

20. The method of claim 19 further comprising slowing the motion of the gate with an energy absorbing element.

21. The method of claim 20 wherein the energy absorbing element is configured to allow the gate to progressively come to rest.

22. The method of claim 20 wherein the energy absorbing element is configured to crumple as it slows the motion of the gate.

23. The method of claim 19 further comprising restraining motion of the gate until gas pressure from the charge reaches a selected threshold.

24. The method of claim 19 wherein the ring cutter comprises a cutting edge formed on a surface of the opening thereon.

25. The method of claim 19 further comprising allowing the gate to pass across the through bore to restrict fluid flow in the through bore.

26. The method of claim 19 wherein the blowout preventer comprises a seal arrangement to restrict fluid flow between the through bore and the passage.

27. The method of claim 19 wherein a pre-initiation spacing between the gate and the ring cutter is at least equal to ½ the diameter of the through bore.

28. The method of claim 19 further comprising moving the ring cutter across the though bore to cut a device in the through bore.

29. The method of claim 19 further comprising restraining motion of a piston disposed between the charge and the gate, until gas pressure from the charge reaches a selected threshold.

* * * * *